US006854233B2

(12) United States Patent
Pitsch et al.

(10) Patent No.: US 6,854,233 B2
(45) Date of Patent: Feb. 15, 2005

(54) QUICK-CONNECT PANEL SYSTEM

(75) Inventors: Terry W. Pitsch, Sumner, WA (US); Sean A. Ross, Enumclaw, WA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/446,304

(22) Filed: May 28, 2003

(65) Prior Publication Data

US 2004/0237416 A1 Dec. 2, 2004

(51) Int. Cl.[7] ..... E04B 2/00

(52) U.S. Cl. ..... 52/584.1; 52/631; 52/239; 52/582.1; 52/243

(58) Field of Search ..... 52/220.1, 239, 52/582.1, 243, 584.1, 631; 403/403, 382, 292, 294, 286, 293

(56) References Cited

U.S. PATENT DOCUMENTS

| | | | | |
|---|---|---|---|---|
| 1,398,582 A | | 11/1921 | Blakeman | |
| 1,831,162 A | | 11/1931 | Crowell | |
| 2,268,669 A | | 1/1942 | Moore | |
| 3,144,733 A | | 8/1964 | Balinski | |
| 3,528,559 A | | 9/1970 | Miller | |
| 3,848,388 A | | 11/1974 | Bretche | |
| 4,774,792 A | | 10/1988 | Ballance | |
| 4,865,066 A | | 9/1989 | Brooks | |
| 4,928,465 A | | 5/1990 | Del Castillo von Haucke | |
| 4,947,601 A | * | 8/1990 | McGuire | 52/239 |
| 5,105,594 A | | 4/1992 | Kirchner | |
| 5,487,690 A | | 1/1996 | Stoffle et al. | |
| 5,640,816 A | | 6/1997 | Reiland et al. | |
| 5,642,557 A | | 7/1997 | Clews | |
| 5,706,624 A | * | 1/1998 | Lipson | 52/745.2 |
| 6,088,980 A | * | 7/2000 | Gulliver | 52/239 |
| 6,536,147 B1 | * | 3/2003 | Funk et al. | 40/605 |

* cited by examiner

*Primary Examiner*—Carl D. Friedman
*Assistant Examiner*—Chi Q Nguyen
(74) *Attorney, Agent, or Firm*—Joseph H. Golant; Jones Day

(57) ABSTRACT

A partition panel system that requires no tools, is easy to handle and is quickly assembled. The partition panel system includes a panel of barrier material surrounded by a frame and several sets of connectors. Each connector of one set of connectors has an "H" shaped configuration for attaching to panels for linear alignment of the panels. Each connector of another set of connectors a configuration for attaching panels at right angles. Other angles may be used by providing variation connectors. The connectors are inexpensive because they may be made from extrusions that are cut to a predetermined length.

19 Claims, 8 Drawing Sheets

167

169
13-13
160
160

167

169
12-12
160
184
182
160

15-15
192
198
190
204
200
194
196
202
16-16

FIG 17
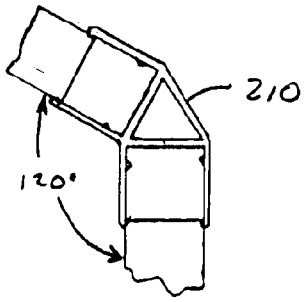
FIG 18
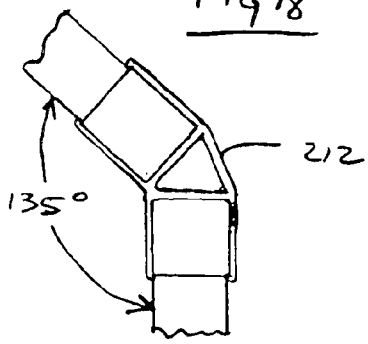
FIG 19
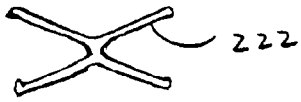
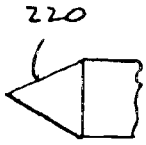
FIG 20
FIG 21
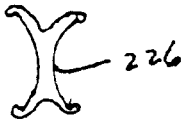
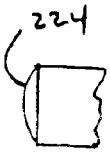
FIG 22
FIG 23
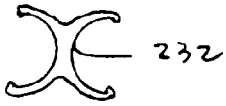
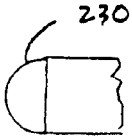
FIG 24
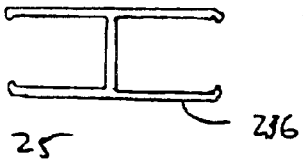
FIG 25
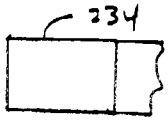
FIG 26

QUICK-CONNECT PANEL SYSTEM

BACKGROUND OF THE INVENTION

CROSS REFERENCE TO RELATED APPLICATIONS

Not applicable.

STATEMENT REGARDING FEDERALLY SPONSORED RESEARCH

Not applicable.

1. Field of the Invention

The present invention relates to a panel system and more particularly to a panel system having inexpensive components and which is easy to use and quick to assemble.

2. Description of the Related Art

Generally, partition panels include a barrier material which is used to divide a space and create privacy and a frame to support and provide rigidity to the barrier material. A system of partition panels also includes a set of connectors to attach the individual panels to create a desired and stable wall formation. Typically connectors are mechanically fastened at the top and bottom of panels or connectors may attach along all, or nearly all, of the vertical length of a panel. Also, typically, such fasteners require tools, skilled labor and substantial time to make proper attachments. Often, when connecting panels of different vertical heights, specialized connectors are required, adding to the cost of the system components, to the time and skill needed for assembly, and to the amount of inventory required.

BRIEF SUMMARY OF THE INVENTION

The difficulties encountered with previous panel systems have been overcome by the present invention. What is described here is a partition system comprising a plurality of panels, each of the panels including a frame having a specific cross-sectional shape, a first set of connectors having a structure to connect two of such panels in a linear manner, and, at least, a second set of connectors having a structure to connect two such panels at an angle, the angle being 90 degrees or more, but less than 180 degrees.

There are a number of advantages, features and objects achieved with the present invention which are not believed to be available in earlier related devices and systems. For example, one advantage of the panel system disclosed here is that the system uses relatively inexpensive components. Other objects of the present invention are extreme ease of use and of handling. A further feature of the present invention is that the panel system disclosed may be assembled very quickly.

A more complete understanding of the present invention and other objects, advantages and features thereof will be gained from a consideration of the following description of preferred embodiments read in conjunction with the accompanying drawing provided herein. The preferred embodiments represent examples of the invention which are described here in compliance with Title 35 U.S.C. section 112 (first paragraph), but the invention itself is defined by the attached claims.

BRIEF DESCRIPTION OF THE SEVERAL VIEWS OF THE DRAWING

FIG. 17 is a partial cross-sectional view showing a 120 degree connector and two panels.

FIG. 18 is a partial cross-sectional view showing a 135 degree connector and two panels.

FIG. 19 is a cross-sectional view of another connector embodiment.

FIG. 20 is a cross-sectional view of a frame configured to mate with the connector shown in FIG. 19.

FIG. 21 is a cross-sectional view of still another connector embodiment.

FIG. 22 is cross-sectional view of a frame configured to mate with the connector shown in FIG. 21.

FIG. 23 is a cross-sectional view of yet another connector embodiment.

FIG. 24 is a cross-sectional view of a frame configured to mate with the connector shown in FIG. 23.

FIG. 25 is a cross-sectional view of another connector embodiment.

FIG. 26 is a cross-sectional view of a frame configured to mate with the connector shown in FIG. 25.

DETAILED DESCRIPTION OF PREFERRED EMBODIMENTS OF THE INVENTION

Figure 1:
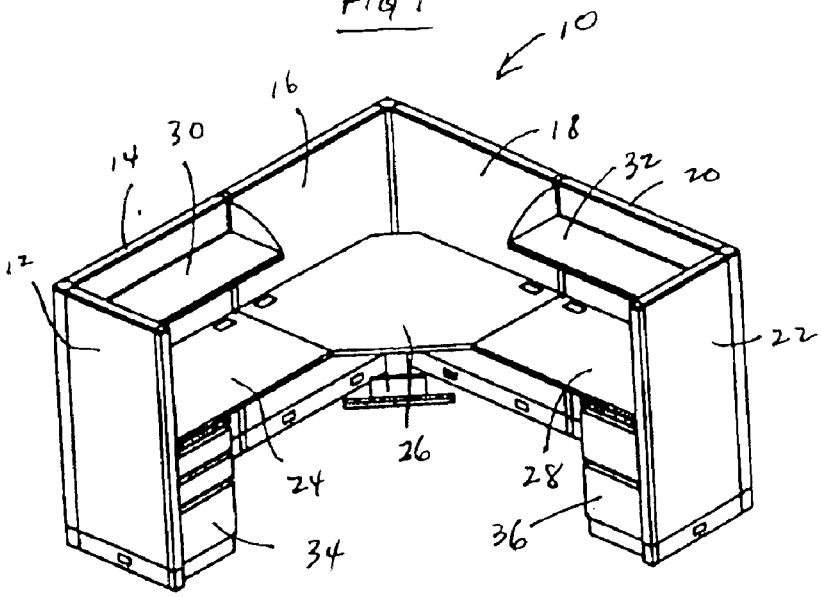
FIG. 1 is an isometric view of a workstation formed by an arrangement of panels.

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
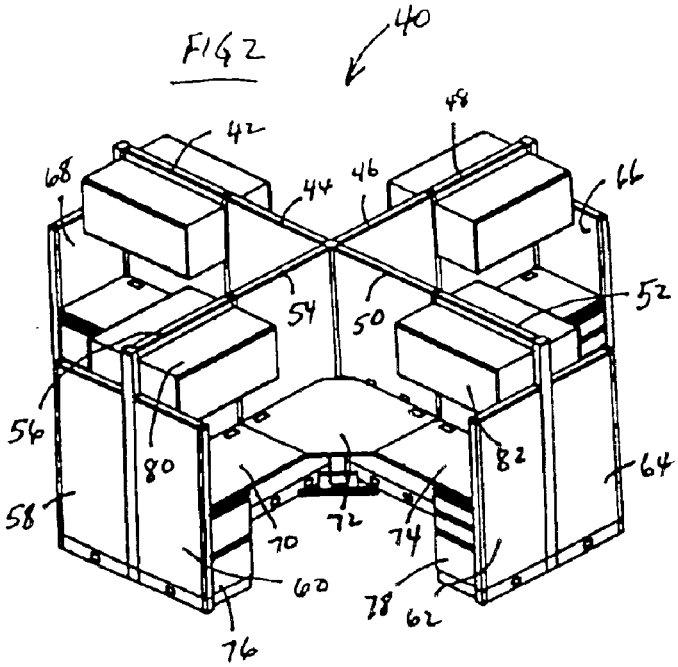
FIG. 2 is an isometric view of a cluster of workstations and illustrating another arrangement of panels.
Figure 3:
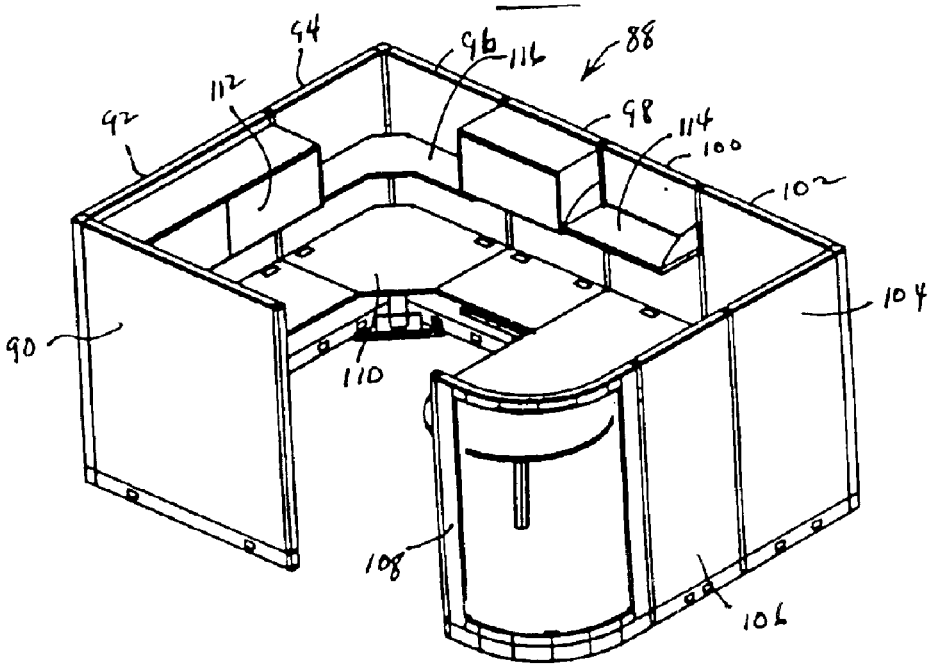
FIG. 3 is an isometric view of yet another workstation illustrating still another arrangement of panels.

Referring to FIGS. 1, 2 and 3, three different workstation configurations are illustrated having different arrangements of a panel system. FIG. 1 illustrates an "L Station" 10 having six panels 12, 14, 16, 18, 20, 22, three work surfaces 24, 26, 28, two bookshelves 30, 32 and two pedestals 34, 36.

A "Quad Station" 40 is illustrated in FIG. 2. The Quad Station includes sixteen panels of which only fourteen are shown. These includes tall panels 42, 44, 46, 48, 50, 52, 54, 56 disposed in a cross configuration and smaller outer panels 58, 60, 62, 64, 66, 68. In addition, each station includes three work surfaces, such as the work surfaces 70, 72, 74, two pedestals, such as the pedestals 76, 78 and two cabinets each, such as the cabinets 80, 82.

In FIG. 3 there is illustrated an office arrangement 88 called a "Manager's Office" which includes ten panels 90, 92, 94, 96, 98, 100, 102, 104, 106, 108, several work surfaces, such as the work surface 110, several cabinets, such as the cabinet 112, a bookshelf 114 and a shelf 116. As can be seen in FIGS. 1–3, the partition panels may vary in size and be configured in different arrangements or patterns.

Figures 4, 5, 6, 7, 8:
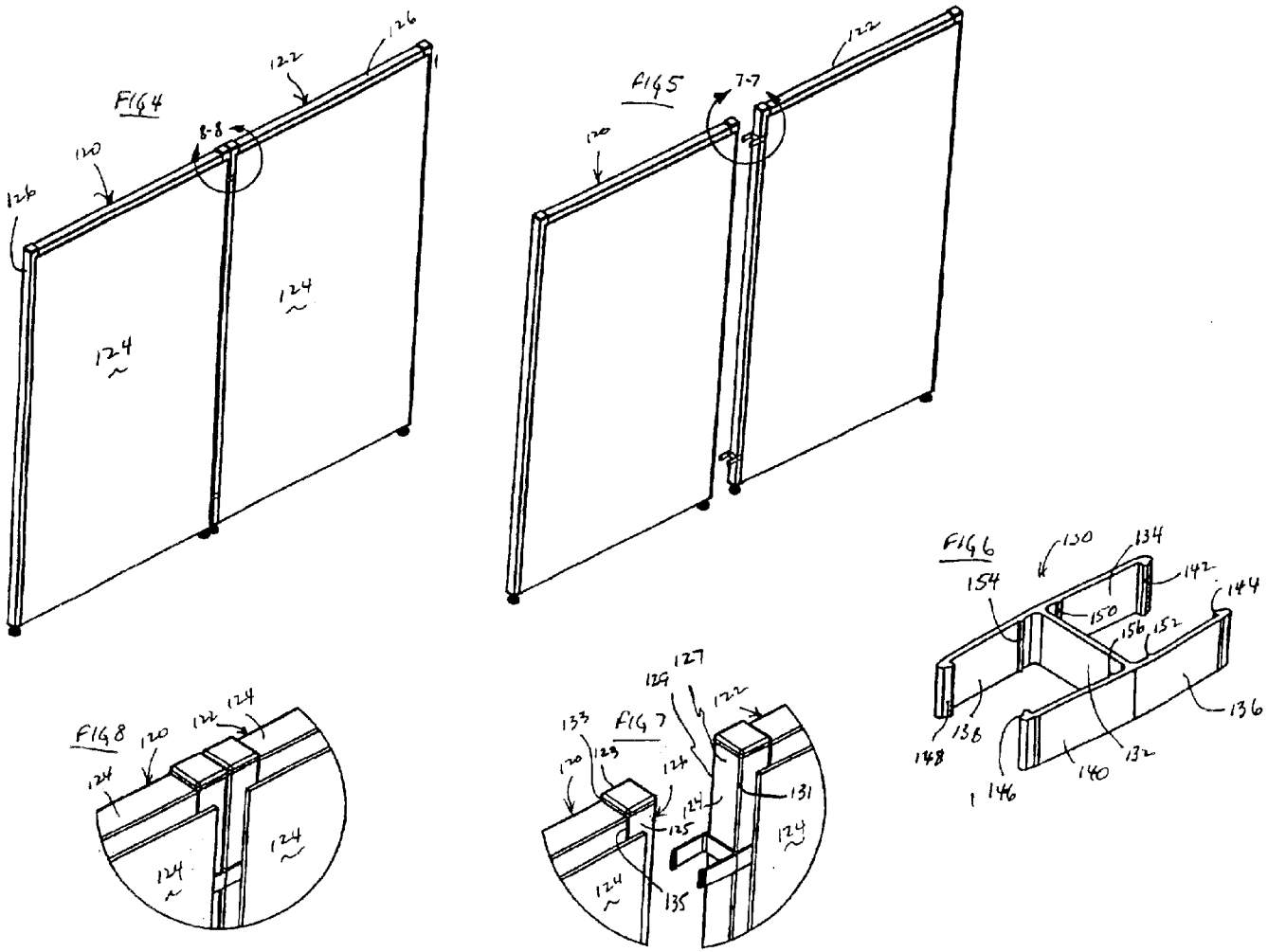
FIG. 4 is an isometric view illustrating two panels connected in a linear assembly.
FIG. 5 illustrates the two panels shown in FIG. 4 in an aligned but unconnected configuration.
FIG. 6 is an enlarged isometric view of one embodiment of a panel connector.
FIG. 7 is an enlarged view taken within circle 7—7 of FIG. 5.
FIG. 8 is an enlarged view taken within circle 8—8 of FIG. 4.

Referring now to FIGS. 4, 5, 7 and 8, there is illustrated two panels 120, 122 connected in FIG. 4 in a linear or one-hundred eighty degrees configuration and the same two panels before connection in FIG. 5. Each partition panel includes a barrier material 124 surrounded by a frame 126. The frame borders the barrier material and provides strength, support and rigidity. Each frame includes side walls, such as the side walls 123, 125. FIG. 7, a front wall, such as the front wall 127, and two front and two rear corners, such as the corners 129, 131 and 133, 135, respectively. The barrier material is extensive and functions to divide space, create privacy and absorb sound.

The panel system described here requires no tools or other fasteners for assembly and for the stability needed. Further, it will be come apparent that assembly is quick and easy and that the system components are inexpensive. Referring now to FIG. 6, there is illustrated a single connector 130 for connecting adjacent partition panels together. The connector 130 has a generally H-shape, including a base 132 and two arms 134, 136 extending in a first direction and two arms 138, 140 extending in an opposite direction. Each set of arms includes an open region between them which enables the two arms to receive a frame, such as is shown in FIG. 7. Each arm includes end barbs or projections 142, 144, 146, 148 at the extended end of the arm and other protrusions or projections 150, 152, 154, 156 for engaging the frame. The interior cross-sectional shape of the connector between a set of arms is essentially identical to the external cross-sectional shape of the frame. The connector may be made of any suitable material, such as aluminum, reinforced plastic or even die cast material. The connector may be formed as part of an extrusion, cut to size, so as to minimize expense of the connector component of the panel system.

The arms of the connector are structured to be able to flex due to the camming action of the side walls of the frame against the end barbs during insertion of the frame into the opening between a pair of arms. When the frame is fully received and the camming action ceases, the arms are able to snap back around the rear corners of the frame to ensure a tight interference fit, such as shown in FIG. 8. The other protrusions abut the front corners of the frame.

The configuration of the connector is such that it enables the connected panels to align in a linear fashion. The linear manner of connection allows the panels to be oriented side by side at an angle of one hundred eighty degrees. Such an arrangement might be used, for example, to connect the panels 14 and 16 of the L Station, FIG. 1.

Figure 9:
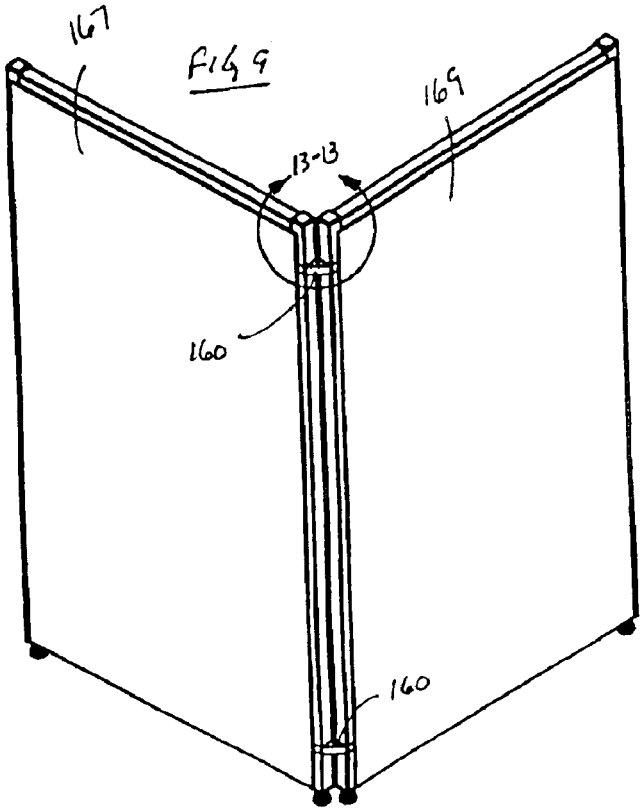
FIG. 9 is an isometric view illustrating two panels connected at a right angle.
Figure 10:
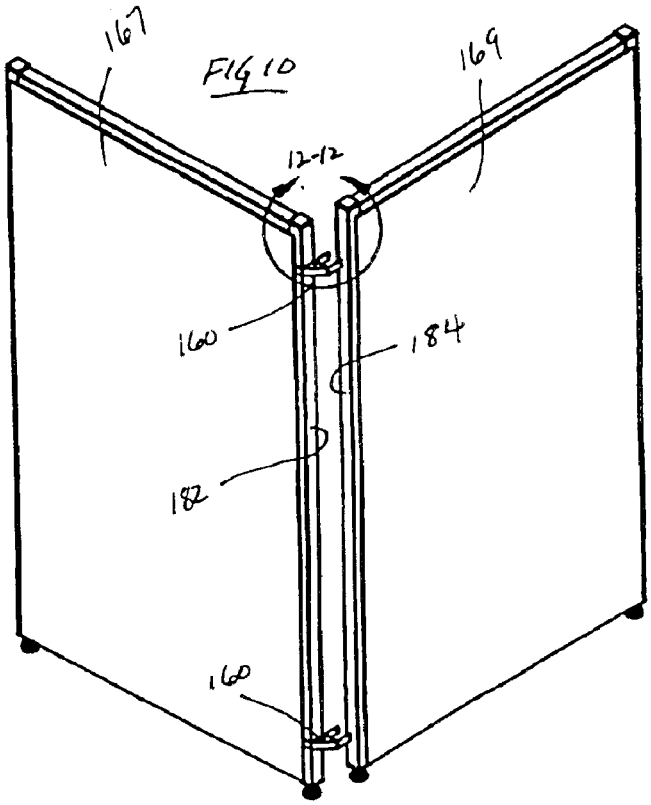
FIG. 10 is an isometric view illustrating the two panels shown in FIG. 9 before being connected.
Figure 11:
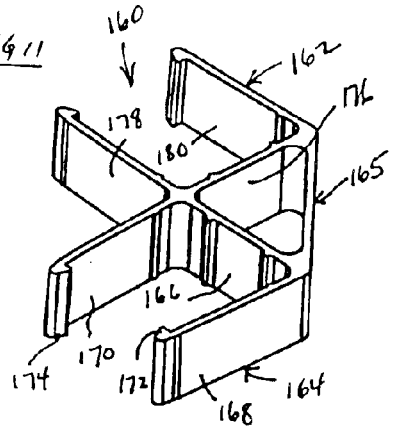
FIG. 11 is an enlarged isometric view of a second embodiment of a panel connector.
Figure 12:
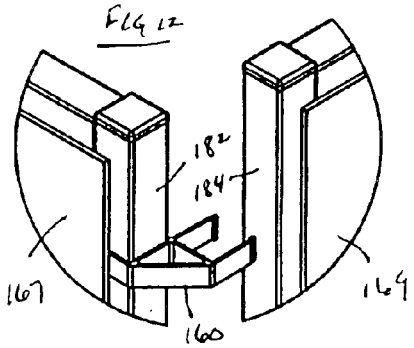
FIG. 12 is an enlarged view taken within circle 12—12 of FIG. 10.
Figure 13:
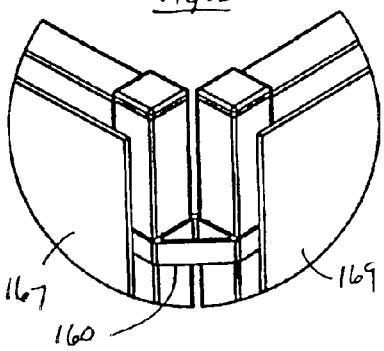
FIG. 13 is an enlarged view taken within circle 13—13 of FIG. 9.

Another connector embodiment 160 shown in FIG. 11 includes two U-shaped portions 162, 164 and a bridge 165 portion. The construction of the connector 160 enables two panels 167, 169 to align at ninety degrees as shown in FIGS. 9 and 10. As with the linear connector 130, FIG. 6, the right angle connector 160, FIG. 11, includes a first portion with a base 166, two flexible arms 168, 170, each arm ending in a barb 172, 174, and a second portion with a base 176 and two extending arms 178, 180 extending at right angles to the first mentioned arms 168, 170. Also, as with the linear connector 130, FIG. 6, the frames 182, 184 of the panels are received between the arms. During attachment, the arms are cammed outwardly until the frame is fully received at which time the arms snap into an interference fit with the panel frames. This is most clearly shown in FIGS. 12 and 13 illustrating the panels just before attachment and after attachment is complete.

Figure 14:
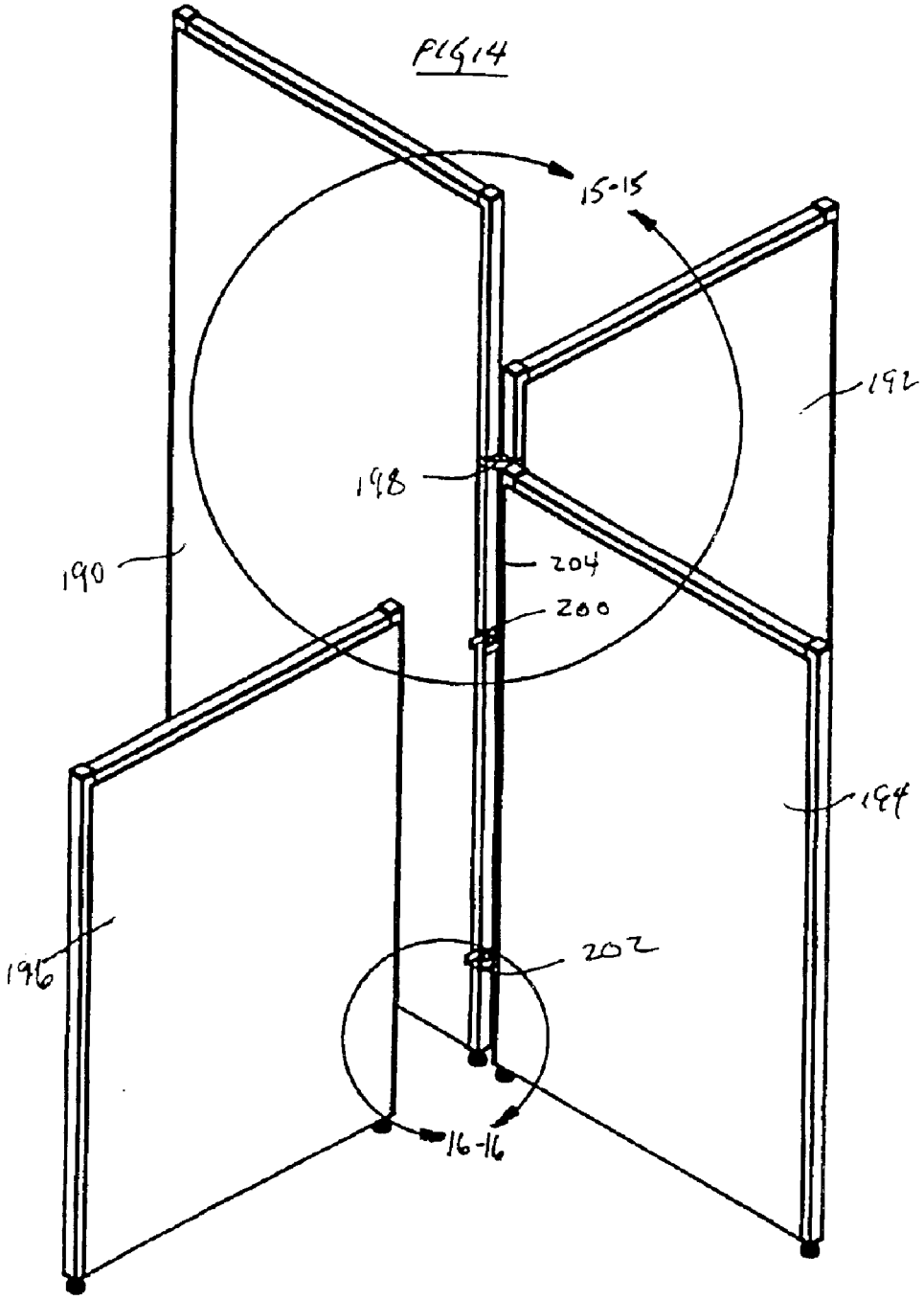
FIG. 14 is an isometric view of four different sized panels partially assembled.
Figure 15:
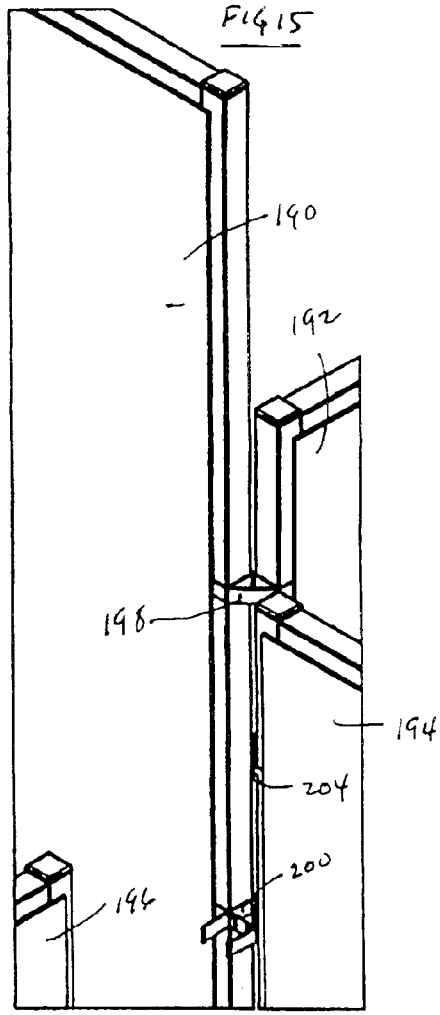
FIG. 15 is an enlarged view taken with circle 15—15 of FIG. 14.
Figure 16:
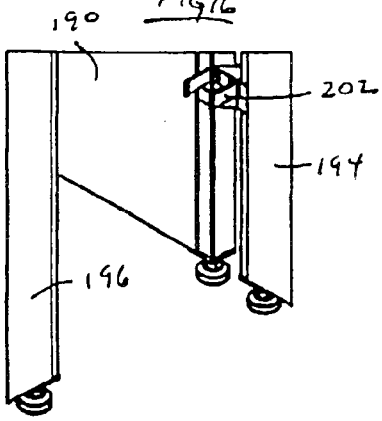
FIG. 16 is an enlarged view taken with circle 16—16 of FIG. 14.

Referring now to FIGS. 14, 15, and 16, the right angle connector is used to connect different height panels 190, 192, 194, 196 in a cross shaped arrangement. A first right angle connector 198 attached panels 190 and 192, a second right angle connector 200 will connect panels 190 and 196, a third right angle connector 202 connects panels 194 and 196 and a fourth right angle connector 204 attaches panels 192 and 194. Of course, other connectors may be used and the panels may be of the sane height, or two of the panels may be of one height and the other two panels of a second height, or three panels may be of the same height and one panel may be of a different height. Any combination of panels may be connected in the fashion just described because of the versatility of the connectors being used.

It is to be noted that the right angle connector 160, FIG. 11, may be modified by shortening the bridge portion 165 so that a different connector with the two sets of arms ascribing an angle of one hundred twenty degrees is formed as shown by a connector 210, FIG. 17, or one hundred thirty-five degrees as shown by a connector 212, FIG. 18. It is to be understood that a connector of any angle from ninety degrees to one hundred eighty degrees may be constructed simply by adjusting the length of the bridge portion.

Other specific cross-sectional frame configurations may also be used besides the square shaped frame shown in FIGS. 4, 5, 7–10, 12 and 13. For example, a frame 220 may have a triangularly shaped cross-section as shown in FIG. 20 with a matching connector 222, FIG. 19, having a cross-section in the shape of an "X". Or, a frame 224 may have the cross-sectional shape of half an oval or "D" shape as shown in FIG. 22 to match a connector 226, FIG. 21, featuring a complementary cross-sectional configuration.

In FIG. 24 a frame 230 has a half-circle cross-section for mating with a connector 232, FIG. 23, having a back to back "C" shape in cross-section. Another example is shown in FIG. 26 where a frame 234 having a rectangular cross-section mates with a connector 236 having an "H" shape like that of the connector 130, FIG. 6, but with longer arms. Each panel system includes a specific cross-sectional shape for the panel frame and a mating cross-sectional shape for the connectors.

In operation, a workstation using the partition panel system disclosed above may be easily constructed without the need for tools. Instead, two connectors, one high and one low, may be attached to a panel by snapping the two connectors around the frame of the panel. Thereafter, a second panel is located at an angle generally from and including ninety degrees to and including one hundred eighty degrees (depending on the connectors used) and snapped into the connectors. In this fashion, a workstation may be quickly assembled by minimally trained personnel because the system is so easy to use. In addition, the arrangement of the panels may be quickly assembled, or disassembled and reassembled into a different configuration.

The above specification describes in detail several preferred embodiments of the present invention. Other examples, embodiments, modifications and variations will, under both the literal claim language and the doctrine of equivalents, come within the scope of the invention defined by the appended claims. For example, different materials may be used, or different barb shapes, or different angled connectors, and these are considered equivalent structures and will come within the literal language of the claims. Still other alternatives will also be equivalent as will many new technologies. There is no desire or intention here to limit in any way the application of the doctrine of equivalents nor to limit or restrict the scope of the claims.

What is claimed is:

1. A partition panel system comprising in combination:

a plurality of partition panels, each partition panel formed of a barrier material bordered by a frame, said frame having two walls and two corners;

a plurality of connectors having a first configuration for connecting partition panels in a linear manner, said first configuration connectors having two opposed openings, each of said first configuration connectors having a base and two pairs of arms, a first pair of arms extending in a first direction and a second pair of arms extending in a second direction, said second direction being one hundred eighty degrees removed from said first direction, said first and second pairs of arms structured to conform to the walls of frames of adjoining partition panels and to engage said corners by creating an abutment between said corners and said arms; and a plurality of connectors having a second configuration for connecting partition panels at an angle other than 180 degrees, said second configuration connectors having two openings, each of said second configuration connectors having a triangular support and two pairs of arms, a first pair of arms extending in a first direction and a second pair of arms extending in a second direction, said second direction being less than one hundred and eighty degrees and being equal to or greater than ninety degrees removed from said first direction, said first and said second pairs of arms structured to conform to the walls of adjoining partition panels and to engage said corners by creating an abutment between said corners and said arms, wherein said first configuration connectors, said second configuration connectors and said partition panels are used to create a partitioned space.

2. The partition panel system as claimed in claim 1 wherein:

said second configuration connectors are formed at an angle from the group of angles including 90 degrees, 120 degrees and 135 degrees.

3. The partition panel system as claimed in claim 1 wherein:

said frame has a square cross-sectional shape.

4. The partition panel system as claimed in claim 1 wherein:

the cross-sectional shape of said frame is curved.

5. The partition panel system as claimed in claim 1 wherein:

said plurality of partition panels includes partition panels of different heights.

6. The partition panel system as claimed in claim 5 wherein:

said second configuration connectors are formed at an angle from the group of angles including 90 degrees, 120 degrees and 135 degrees.

7. The partition panel system as claimed in claim 6 wherein:

said frame has a square cross-sectional shape.

8. The partition panel system of claim 1 wherein:

each arm of said first and said second pairs of arms of said plurality of connectors having the first configuration and the second configuration includes an extended end portion having a projection extending inwardly toward the other arm of a pair of said first and said second pairs of arms.

9. The partition panel system as claimed in claim 8 wherein:

said projection causes an attached arm to flex upon engaging a wall of a frame and to abut a corner when completely engaged.

10. The partition panel system as claimed in claim 1 wherein:

each arm of said first and said second pairs of arms of said plurality of connectors having the first configuration and the second configuration includes an extended end portion having a projection extending inwardly toward the other arm of a pair of said first and said second pairs of arms; and each arm of said first and said second pairs of arms of said plurality of connectors having the first configuration and the second configuration includes a second projection spaced from said first mentioned projection a distance equal to the length of a wall.

11. The partition panel system as claimed in claim 10 wherein:

said first mentioned projection and said second projection are parallel to each other.

12. The partition panel system as claimed in claim 10 wherein:

said second projection is spaced from said base or said triangular support of said plurality of connectors having the first and the second configurations.

13. The partition panel system as claimed in claim 1 wherein:

said second direction of said plurality of connectors having the second configuration is ninety degrees removed from said first direction; and one pair of said plurality of connectors having a second configuration where the second direction is ninety degrees removed from said first direction is used to connect two adjoining partition panels.

14. The partition panel system as claimed in claim 1 wherein:

said second direction of said plurality of connectors having the second configuration is ninety degrees removed from said first direction; and two pairs of said plurality of connectors having the second configuration where the second direction is ninety degrees removed from said first direction are used to connect three adjoining partition panels.

15. The partition panel system as claimed in claim 1 wherein:

said second direction of said plurality of connectors having the second configuration is ninety degrees removed from said first direction; and three pairs of said plurality of connectors having the second configuration where the second direction is ninety degrees removed from said first direction are used to connect four adjoining partition panels.

16. The partition panel system as claimed in claim 1 wherein:

said second direction of said plurality of connectors having the second configuration is ninety degrees removed from said first direction;

one pair of said plurality of connectors having a second configuration where the second direction is ninety degrees removed from said first direction is used to connect two adjoining partition panels;

two pairs of said plurality of connectors having the second configuration where the second direction is ninety degrees removed from said first direction are used to connect three adjoining partition panels; and three pairs of said plurality of connectors having the second configuration where the second direction is ninety degrees removed from said first direction are used to connect four adjoining partition panels.

17. The partition panel system of claim 1 wherein:

said frame of each of said partition panels has two opposing side walls, a front wall and four corners;

each arm of said first and said second pairs of arms of said plurality of connectors having the first configuration and the second configuration includes an extended end portion having a projection extending inwardly toward the other arm of a pair of said first and said second pairs of arms;

said projection causes an attached arm to flex upon engaging a side wall of a frame and to abut a corner when completely engaged; and said pair of arms snap around two of said four corners when completely engaged with a frame.

18. The partition panel system of claim 17 wherein:

each arm of said first and said second pairs of arms of said plurality of connectors having the first configuration and the second configuration includes a second projection spaced from said first mentioned projection a distance equal to the length of a side wall.

19. The partition panel system of claim 18 wherein:

when completely engaged, said second projection of each arm abuts a front wall of the frame and each pair of arms extend along the side walls of the frame.

* * * * *